United States Patent [19]

Harada et al.

[11] 4,094,274

[45] June 13, 1978

[54] FUEL INJECTION CONTROL SYSTEM

[75] Inventors: Susumu Harada, Oobu; Masakazu Ninomiya, Kariya, both of Japan

[73] Assignee: Nippondenso Co., Ltd., Kariya, Japan

[21] Appl. No.: 711,603

[22] Filed: Aug. 4, 1976

[30] Foreign Application Priority Data

Aug. 8, 1975 Japan ..... 50-96879

[51] Int. Cl.[2] ..... F02B 3/00

[52] U.S. Cl. ..... 123/32 EL; 123/198 DB; 123/97 B

[58] Field of Search ..... 123/198 DB, 32 EA, 102, 123/32 EL, 97 B

[56] References Cited

U.S. PATENT DOCUMENTS

| | | | |
|---|---|---|---|
| 3,601,103 | 8/1971 | Swiden | 123/198 DB |
| 3,916,865 | 11/1975 | Klencke | 123/32 EL |

*Primary Examiner*—Ronald B. Cox
*Attorney, Agent, or Firm*—Edwin E. Greigg

[57] ABSTRACT

A control circuit for a fuel injection system used with internal combustion engines, of the type in which fuel injection valve control pulses are generated whose duration depends on engine data, in particular engine rpm and air flow rate. To avoid misfires when the engine is run fast with a closed throttle, the fuel supply is shut off by suppression of the fuel control pulses. For this purpose, the control circuit generates a reference rpm value and a reference pulse train of predetermined pulse duration and compares the duration of the actual fuel injection control pulses with the predetermined duration and, at the same time, it compares the actual rpm with the reference rpm. If the actual pulse duration is less than the reference duration and if the actual rpm is greater than the reference rpm, the control circuit suppresses the fuel injection control pulses.

9 Claims, 3 Drawing Figures

1
2
3
4
5
6
7
8
9
10
11
12
13
14
15
16
17
17a
T1 (tp)
T2 (tm)
T3 (tu)
(tp+ tm+tu)
T a)
b)
c)
d)
e)
f)
to

FUEL INJECTION CONTROL SYSTEM

BACKGROUND OF THE INVENTION

The invention relates to fuel injection systems for internal combustion engines in which the fuel injection valves are actuated by electrical fuel control pulses whose duration determines the amount of fuel provided to the engine. The fuel control pulses are generated by an electronic control circuit and their duration is determined primarily on the basis of the instantaneous engine rpm and the air flow rate aspirated by the engine. More particularly, the invention relates to a method and an apparatus for interrupting the fuel control pulses during certain operational phases of the engine, for example during engine braking so as to avoid misfires and exhaust system explosions.

In known apparatus and systems for causing a fuel interruption, a throttle valve transducer senses the position of the throttle flap and when this transducer indicates that the throttle valve opening has fallen below a certain predeterminable value, while the rpm of the engine exceeds a predetermined value, the interruption of the fuel takes place. The throttle valve transducer must follow a sensor function provided by a throttle valve switch, which increases the cost because the throttle angle must be subjected to a correction. A disadvantage of this apparatus is that, in the domain in which the throttle valve is only slightly further open than a predetermined setting of the throttle valve switch and when the rpm has already exceeded the predetermined value, the fuel supply is not interrupted. On the other hand, the probability that the internal combustion engine will already be subject to functional disturbances such as ignition delays, ignition failure, exhaust gas explosions, etc., is related to the flow characteristics of the electromagnetic injection valves and the displacement of the engine. This general domain, which can only be imprecisely defined, makes it very difficult to provide control pulses for the electromagnetic valves whose pulse width is a linear function. This is especially true if the engine has cylinders of small displacement and the aspirated air quantity is relatively small which requires that the amount of fuel delivered by the fuel injection valves be small. In general, when the duration of fuel injection pulses falls below a certain minimum width, it is very difficult to produce the required control components or to operate them and it requires substantial expense to insure proper operation of the engine in this domain of relatively high rpm but very short fuel injection pulses. Overall, there is a multitude of disadvantages which in known fuel injection systems consist, for example, in that a precise control of the fuel quantity as a function of the aspirated air is no longer possible and misfires occur. Again, there may be incomplete or faulty combustion of the mixture which is then exhausted and may contain components which are very detrimental to the exhaust system itself and may also be toxic; especially there may be a high concentration of hydrocarbons.

When the engines are provided with exhaust gas clean-up devices, such as catalyzers, thermoreactors, etc., the increased heating of these devices by misfires is substantially increased, which may result in their destruction.

It has been attempted to counteract these disadvantages by providing vacuum limiters and throttle valve dampers which are actuated by the vacuum in the induction tube of the engine and which affect the quantity of aspirated air. However, these measures do not have the desired result and furthermore the installation of a vacuum limiter has the problem that the engine rpm does not decrease if the throttle is not actuated at the same time. Furthermore, the reliability of these rather expensive additional systems is in doubt.

OBJECT AND SUMMARY OF THE INVENTION

It is a principal object of the invention to provide a method and an apparatus for interrupting the fuel supply of an internal combustion engine by suppressing the fuel injection control pulses. The domain of applicability of the invention is particularly that where the vehicle operates with engine braking and the method and apparatus of the invention insure that misfires and exhaust gas explosions are avoided and that any difficulties due to fast engine operation in the warm-up phase of the engine are prevented. Briefly stated, the invention provides that, before the fuel supply is interrupted, for example by blockage of the fuel injection control pulses, two separate conditions of operation must be met. The first of these conditions is that the duration of the calculated fuel injection pulse be smaller than a predetermined adjustable minimum duration and the second condition is that the engine must run faster than a predetermined lower rpm. The existence of both of these conditions indicates that the throttle valve is being closed during fast engine or vehicle operation.

Accordingly, the invention provides two separate circuit systems which generally receive their information from the engine rpm and which function in parallel. One of these circuit systems compares a preset minimum fuel injection pulse duration with the actual pulse duration, for example as calculated from the rpm and the aspirated air flow rate. The other circuit system checks on the rpm limit and delivers an appropriate output signal if the engine rpm exceeds a predetermined speed. Whenever the calculated control pulse width derived from the air quantity and the engine rpm is less than a predetermined value and if, at the same time, the engine rpm exceeds a fixed predetermined value, then the engine fuel supply is interrupted.

Compared with the above-described known systems, the method and the apparatus according to the invention has the advantage that, in the critical operational domain of the engine, the fuel supply is completely interrupted so that misfires and other disturbances cannot occur. The critical operational domain in question is that domain in which the engine rpm and the aspirated air quantity would call for a fuel injection pulse width which is outside of the range in which the electromagnetic valves can function linearly so that the required calculated fuel quantity cannot be reliably delivered.

It is a further advantage that the apparatus according to the invention does not require complicated position sensors or encoders, for example for the throttle valve position, and requires no external transducers but only uses the rpm information and then takes the appropriate steps in the electronic circuit. The apparatus according to the invention also has an advantageous influence on a further substantial circumstance which will now be described. When the internal combustion engine warms up, there occurs a time which permits a relatively high idling rpm while the pulse width of the fuel injection pulses is relatively short. The fuel injection system according to the present invention also responds to this situation and does not completely interrupt fuel supply during the warm-up phase by recognizing that this condition is different from the above-mentioned engine braking in which fuel interruption is desired.

Since the actual interruption of fuel supply requires the existence of two separate conditions, the rpm limit, i.e., the lower minimum rpm at which the injection system according to the invention still considers the engine to be operated with engine braking, can be substantially reduced and may well lie within the fast idling rpm domain and this is done by monitoring the cooling water temperature. In the case of a fast idling, the pulse width of the fuel injection pulses is sufficiently greater than a certain minimum width at which interruption of the fuel supply is to take place. Thus, the fuel injection system according to the invention does not respond to a fast idling condition even though the rpm may be sufficiently high so as to suggest a domain of overrunning or engine braking operation. The system according to the invention recognizes, however, that the engine is actually being idled fast due to the fact that the pulse width is greater than a lower limiting value.

The invention will be better understood as well as further objects and advantages thereof become more apparent from the ensuing detailed specification of a preferred embodiment taken in conjunction with the drawing.

DESCRIPTION OF THE PREFERRED EMBODIMENT

Figure 1:
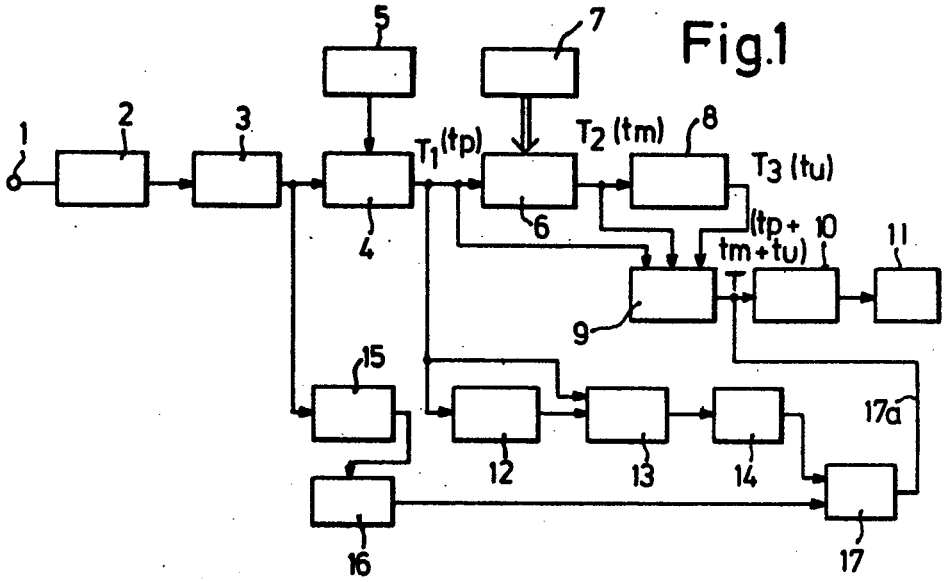
FIG. 1 is a block diagram of the basic circuitry of an electronically controlled fuel injection system.

Turning now to the basic block diagram of FIG. 1, there will be seen a pulse former circuit 2 which receives information at a contact 1 concerning the engine speed or rpm. This information may be derived from the primary winding of the ignition coil or from some other suitable point of the ignition system. The pulse former circuit 2 suppresses erroneous pulses and generates clean waveforms which are fed to the frequency divider circuit 3 which performs a division according to the number of cylinders in the engine. In the case of a six-cylinder engine, the frequency divider circuit 3 would divide the ignition pulses in the ratio 1:3 so that, during each crankshaft rotation, one electromagnetic fuel injection valve 11 would be actuated once.

Of course, if the injection valve 11 is to be actuated more than once or only once for every two crankshaft revolutions, the frequency division would be appropriately different.

The output pulses from the frequency divider circuit 3 are fed to a subsequent computer circuit 4 which also receives a signal related to the quantity of air aspirated by the engine. The computer 4 uses this information to define a duration, i.e., a pulse width *tp* of preliminary fuel injection pulses and the calculation performed consists substantially of dividing the air flow rate by the engine rpm. The duration *tp* of the output pulses T1 is proportional to the air flow rate aspirated per cycle by each cylinder.

The output pulses T1 whose width is *tp* are then fed to a multiplying circuit 6 which also receives information from external sensor 7 regarding certain operational engine parameters, for example the cooling water temperature, the air temperature, etc. The multiplier circuit 6 modifies the pulse width *tp* of the injection pulses to form a pulse train T2 with a pulse width *tm*. Connected to the output of the multiplier circuit 6 is a voltage correction circuit 8 which takes into account the prevailing supply voltage of the motor vehicle and generates appropriate output pulses T3 with a pulse width *tu* so that the duration of the fuel injection pulses is essentially independent of fluctuations in the vehicle voltage.

All three output signals T1, T2 and T3 are then fed to individual inputs of an OR circuit 9 whose output carries the final control pulse sequence T which is generated from the input pulse trains T1, T2 and T3. Depending on the requirements, the final pulse may be equivalent to the input pulse of the longest width. Alternately, the OR circuit may form an output pulse of width $tp + tm + tu$ and these output pulses are fed to an output circuit 10 which actually controls the fuel injection valves with the use of the optimum pulse for each engine condition.

It is noted that the multiplying circuit 6 is so embodied that, if the width of the input pulses T1 is not enlarged by any correction signals, then the output pulse train T2 has the same pulse width as the input pulses. The multiplicative modification of the duration of the input pulse train T1 is proportional to the current which flows into the multiplying circuit 6 and which is based on the correction signals of the transducer circuit 7. The transducer circuit 7 contains all those systems and external sensors which are required for monitoring the relevant operational conditions of the engine.

The apparatus according to the invention further includes a monostable multivibrator 12 which is triggered by the output pulses T1 of the computer circuit 4 and whose own output pulses have a certain predetermined width and are fed to a gating circuit 13. The width of the output pulses from the monostable multivibrator 12 is so chosen as to correspond to those pulses which would result when the engine operates under conditions where a linear control of the pulse width fed to the injection valves 11 is no longer possible. In other words, related to the internal combustion engine, it is that pulse width which would correspond to an operational state of the engine in which the engine could experience misfire, i.e., when such narrow pulses are fed to the valves, there may be missed ignition and delayed ignition. Such an operational state occurs when the engine decelerates, for example during engine braking of a vehicle, i.e., when the engine rpm is relatively high but while the throttle valve is moved into its idling position. In a particular case, the pulse width at which fuel supply ought to be interrupted may, for example, be 0.7 ms approximately.

The preliminary pulses T1 are fed to the gating circuit 13 which is so embodied that it can distinguish between pulses of width *tp* and pulses of width A where A is the width of the pulses from the monostable multivibrator circuit 12. The gating circuit 13 activates a subsequent flip-flop circuit 14 and the connections are made so that the output from the flip-flop circuit 14 is a logical 1 if the pulse width *tp* is larger than the pulse width A, while the output of the flip-flop 14 is a logical 0 if the pulse width *tp* is smaller than the pulse width A.

The circuit according to the invention also includes a digital-analog converter 15 which receives the output pulse train from the frequency divider circuit 3, containing the rpm information of the engine, and delivers an output potential which corresponds to the frequency of the received pulses. Connected behind the digital-analog converter 15 is a comparator circuit 16 which generates a logical 1 if the engine rpm is above a certain predetermined value, and a logical 0 if the actual engine rpm is below a predetermined value.

The output signals from the comparator 16 and from the flip-flop 14 are fed to respective inputs of a gating circuit 17, for example a logical NAND circuit whose output is a logical 1 if both inputs are logical 0, and is a logical 1 in the other three possible cases. The output of the circuit 17 is fed via a line 17*a* to the output of the OR circuit 9 with which it combines and causes the fuel control pulses to be passed on to the output circuit 10 or to be suppressed, thus interrupting the actuation of the fuel injection valves 11.

Figure 2:
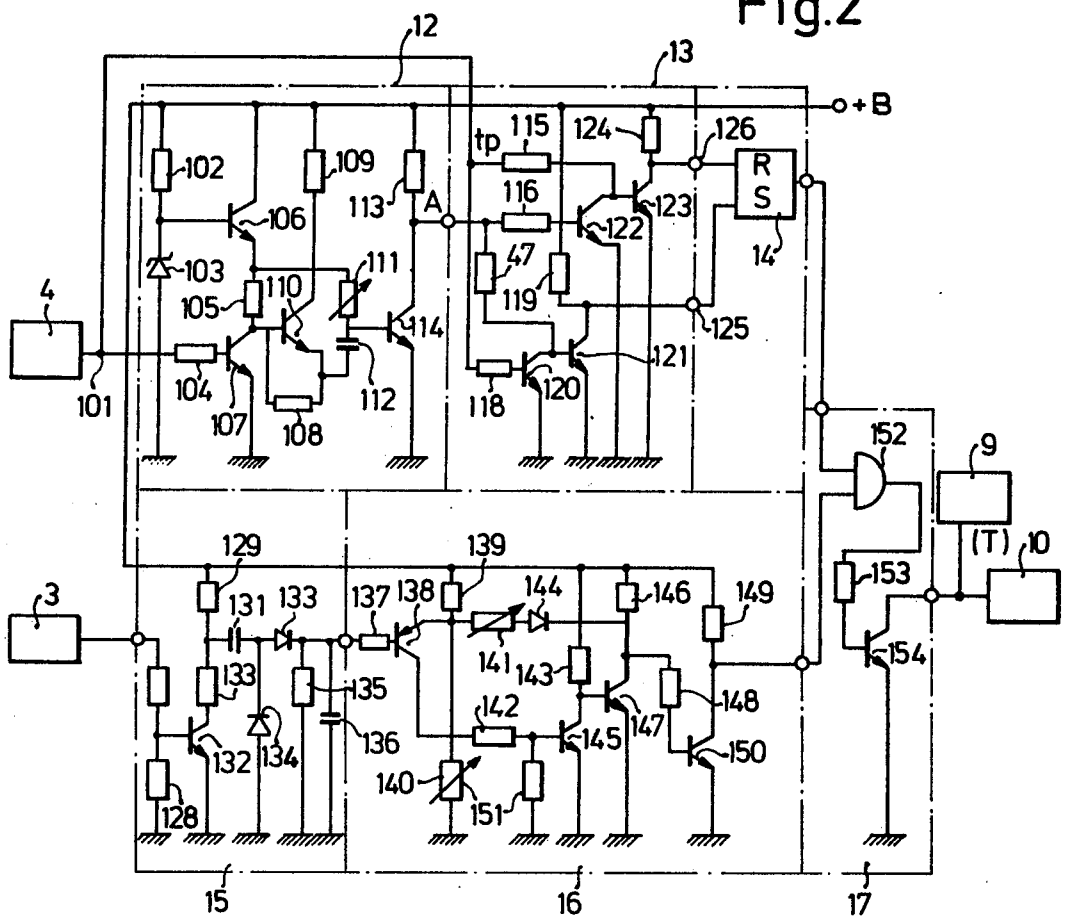
FIG. 2 is a detailed circuit diagram of some of the constituent, important elements of the system in FIG. 1.

FIG. 2 is a detailed circuit diagram of the fuel injection system according to the invention, especially the construction of the monostable multivibrator 12, the gating circuit 13, the digital-analog converter 15 and the comparator 16. It may be seen in FIG. 2 that the monostable multivibrator 12 has an input contact 101 which receives the output pulse train T1 from the computer circuit 4. The monostable multivibrator circuit includes the resistors 102, 104, 105, 108, 109, 111 and 113, a Zener diode 103 for constant voltage as well as the transistors 106, 107, 110 and 114. The connections of these elements may be seen from the detailed illustration of FIG. 2.

If the input contact 101 receives the pulse train T1, the monostable multivibrator generates output pulses A with a pulse duration which is determined by the setting of the potentiometer 111 and the capacitor 112.

The gating circuit 13 which follows the multivibrator 12 includes resistors 115 – 119 and 124, as well as transistors 120 – 123 whose detailed connections may also be seen from the illustration of FIG. 2. The circuit 12 has two output contacts 125 and 126 which are connected, respectively, to the set and reset inputs of a subsequent flip-flop circuit 14. The output signals of the gating circuit 13 differentiate between the pulse widths of the pulses from the multivibrator 12 and those from the computer circuit 4. The difference of these pulse widths is indicative for the control of the subsequent flip-flop 14 as will be explained below in detail.

The digital-to-analog converter 15 includes resistors 127 to 130 and 135, a transistor 132, as well as capacitors 131 and 136 and diodes 133 and 134, and its detailed construction is illustrated in FIG. 2. The input of the digital-to-analog converter 15 receives the output pulses from the frequency divider circuit 3 which place the input transistor 132 into its conductive or its blocking state. The pulses thereby occurring at the collector of the transistor 132 are differentiated by the capacitor 131 and integrated by a subsequent capacitor 136 so that the output of the digital-to-analog converter 15 is a voltage level whose amplitude corresponds to the engine rpm. Connected behind the digital-to-analog converter 15 is the comparator 16 which includes resistors 137, 139 and 143, 146, 149 and 151, a pnp-transistor 138, npn-transistors 145, 147 and 150 and a diode 144. If the output signal from the digital-analog converter 15, which is equal to the base voltage of the transistor 138 in the comparator 16 and which is approximately 0.6 volts in the present example, is higher than the emitter potential of the transistor 138, this transistor blocks so that the transistor 145 also blocks, whereas the transistor 147 conducts and causes blocking of the transistor 150. As a consequence, the comparator delivers the output signal logical 1.

If, on the other hand, the base voltage of the transistor 138 is smaller than the emitter voltage of this transistor, then the transistor 138 conducts as does the transistor 145, whereas the transistor 147 blocks and transistor 150 conducts so that the output of the comparator 16 carries a logical 0 which is taken from the collector of the transistor 150. By changing the resistance in the variable resistor 140, the emitter potential of the transistor 138 is adjustable so that the setting, related to the rpm, at which the transistor 138 blocks, can be preset.

The purpose of the resistor 141 and the diode 144 is to supply a hysteresis characteristic to the behavior of the circuit with respect to the rpm at which fuel supply is interrupted as compared with that rpm at which fuel injection is resumed.

The next sub-circuit in the diagram of FIG. 2 is the control circuit 17 which includes an AND gate 152, a resistor 153 and a transistor 154 whose output controls the transmission of the output pulses from the gate circuit 9 to the output circuit 10. The transistor 154 conducts only if both the output of the flip-flop 14 as well as the output from the comparator 16 indicate a logical 1; in that case the output from the control circuit 17 is a logical 0 so that the fuel injection pulses which are the output signals from the OR circuit 9 are grounded and do not reach the output circuit 10 so that fuel injection is effectively interrupted.

The method of operation of the overall circuit just described is that, when the preliminary fuel injection pulses T1 whose pulse width is *tp* are fed to the monostable multivibrator 12, its input transistor 107 is caused to conduct which triggers the multivibrator 12. As a consequence, the transistor 110 blocks and the collector of the transistor 114 delivers a pulse whose duration is derived from the adjustment of the resistor 111 and the value of the capacitor 112 which serve as the timing elements of this part of the circuit. The output pulse from the capacitor 114 is in synchronism with the input pulses T1. The setting of the time constant of the monostable multivibrator circuit 12 defines the duration of its output pulses during the time when the transistor 114 is blocked.

The timing diagrams 3*a* and 3*b* illustrate the output pulses from the monostable multivibrator and the computer circuit 4, respectively. These output pulses, which are then fed to the gating circuit 13, result in the following switching states. If the pulse duration A (the duration of the output pulses from the multivibrator circuit 12) is smaller than the pulse width *tp* of the pulse train T1, then the transistor 123 conducts only during the time *tp*-A and the output contact of the gating circuit 13 which acts on the reset input 126 carries the potential indicated in FIG. 3*c*.

If, on the other hand, the duration A of the unstable state of the monostable multivibrator 12 is larger than the time *tp* of the injection pulses T1, then the transistor 121 conducts only during the time formed by the difference A-*tp* and the output contact 125 which controls the set input of the flip-flop 14 carries the potential indicated in FIG. 3*d*.

Thus the gating circuit 13 acts somewhat in the manner of a discriminator and the appearance of signals at its respective outputs 126 and 125 indicates whether the duration of the unstable state of the multivibrator 12, which is a minimum pulse width, is in fact greater or smaller than the duration *tp* of the actual injection pulses. This discrimination is obtained by feeding the input pulses A and those of width *tp* to different and sequential systems of the transistors 122, 123 or 120, 121, respectively and because these transistors conduct at different times, they produce the output pulses shown in FIGS. 3*c* and 3*d*.

Figure 3:
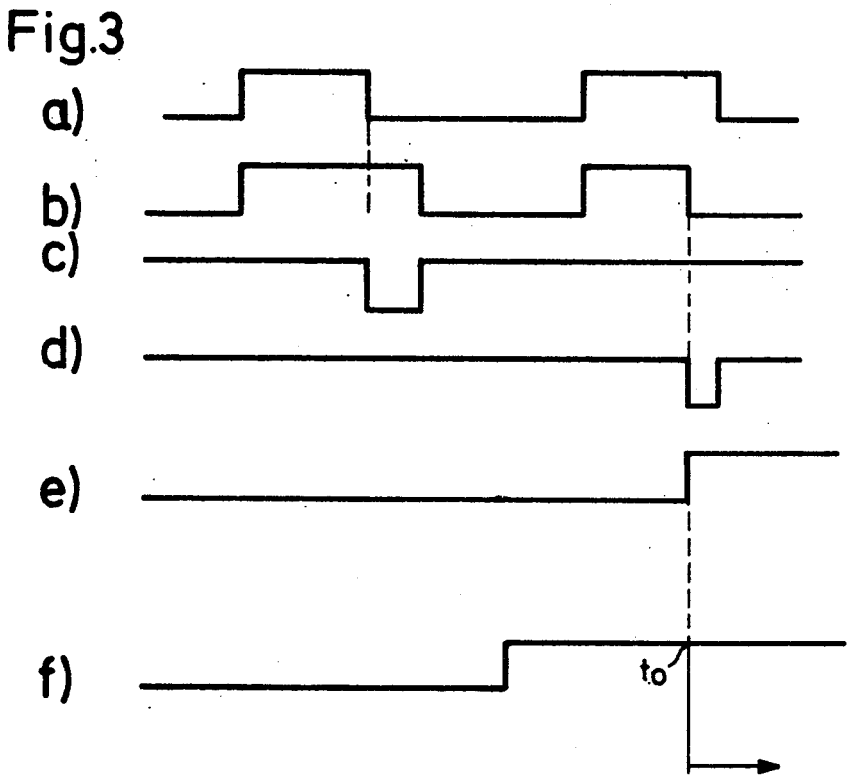
FIG. 3 shows various timing diagrams that illustrate the voltage occurring as a function of time in several places of the circuit.

The tie-up with the subsequent flip-flop 14 then insures that if, for example, *tp* is less than A, the output of the flip-flop 14 is a logical 1 as shown in FIG. 3*e*, and thus fulfills the first condition for interrupting fuel supply, i.e., the grounding of the fuel injection pulses. The diagram 3*e* also shows that if the output of the flip-flop 14 is a logical 0, that state is unchanged by the arrival of a 0 signal at the set input S (according to FIG. 3*c*); it is only the logical signal 0 of FIG. 3*d* which flips the flip-flop 14 back into its other state. The return to the initial state, by an appropriate pulse from the discriminator 13, takes place when the normal condition has been restored and the duration *tp* of the essentially calculated fuel injection pulses T1 is greater than the time A. As already mentioned above, the engine rpm information is transformed by the digital-to-analog converter 15 into an rpm-proportional voltage which is compared by the comparator 16 with a fixed threshold voltage. If the input voltage to the comparator is smaller than the threshold voltage, the output of the comparator indicates a logical 0 and if the input voltage is greater than the threshold, the output of the comparator carries a logical 1, as shown in the diagram 3*f*, which illustrates that the output of the comparator changes to the state 1 at some arbitrary time. Beginning at the time $t_o$, which is the same time for all of the diagrams shown in FIG. 3, both of the required conditions for interrupting the fuel supply are, in fact, satisfied (the output of the comparator 16 as well as the output of the flip-flop 14 are a logical 1), the transistor 154 conducts and the injection pulses delivered by the OR circuit 9 are interrupted prior to being fed to the output circuit 10. If one of these two conditions is not satisfied, the control circuit 17 does not interrupt the conduction of the final control pulses T to the output circuit 10.

It will be appreciated that some other configuration or influence on the control circuit 17 may be considered; for example, the control circuit 17 may produce a suitable fuel shut-off signal to some prior sub-circuit ahead of the OR circuit 9.

In the fuel injection system according to this invention, it is advantageous that means are provided which permit the interruption of the fuel supply when the vehicle operates in a manner which tends to decelerate the engine, for example in engine braking, and which become effective if the pulse width *tp* of the control pulses normally fed to the electromagnetic injection valves 11 is less than a previously determined pulse width A which is small enough to imply the probability of misfires and delayed ignition, if, at the same time, the rpm of the engine is higher than a predetermined minimum rpm. Thus, by defining a region of operation in which misfires could occur during engine braking or similar conditions, the exhaust of uncombusted gases is effectively prevented by shut-off of the fuel supply.

It is another advantage of the invention that complicated transducers and encoders for monitoring the degree of opening of the throttle valve and the rpm of the engine are not required so that the embodiment of the present invention may be used with a considerable economy.

In fuel injection systems built according to the present state-of-the-art, the engine receives an additional air quantity through a bypass at a certain rpm so that, during the engine starting, the engine may run smoothly even at low temperature. Such a provision might be called "fast idling" and serves to increase the engine rpm. This provision insures that through sensing the cooling water temperature or other operational data of the engine, the rpm at which fuel control pulse interruption takes place is made independent of the "fast idling rpm". The fuel injection system according to the present invention is so constructed that, during fast idling, the width of the fuel injection pulse is greater than the predetermined pulse width for interrupting fuel supply. Thus, the predetermined pulse width is compared with the pulse width derived from the aspirated air quantity in the rpm. For this reason, the rpm at which fuel supply is interrupted is unchanged by the cooling water temperature and it is also possible to lower the rpm at which fuel supply is actually stopped. The total effect of these features is a substantial simplification for the fuel injection system as a whole.

The foregoing relates to a preferred exemplary embodiment of the invention, it being understood that variants thereof are possible within the spirit and scope of the invention, the latter being defined by the appended claims.

What is claimed is:

1. A method for controlling fuel injection in an internal combustion engine which includes means for generating fuel injection control pulses whose duration depends on engine parameters, comprising the steps of:

determining a reference pulse duration;

determining a reference rpm;

comparing the control pulse width with said reference pulse duration;

comparing the engine rpm, with said reference rpm;

interrupting fuel supply to the engine when the control pulse duration is less than said reference pulse duration and the engine rpm is greater than said reference rpm.

2. A method as defined in claim 1, wherein the step of determining a reference pulse duration includes providing a monostable multivibrator whose time constant is adjusted to equal said reference pulse duration; the step of comparing the engine rpm with a reference rpm includes providing a digital-to-analog converter for converting rpm-related pulses to an analog signal, and comparing said analog signal with a threshold voltage, and the step of interrupting fuel supply includes suppression of said fuel injection control pulses.

3. An apparatus for controlling fuel injection in an internal combustion engine which includes fuel injection valves and means for generating fuel injection control pulses whose duration depends on engine variables, comprising:

timing means for generating a reference pulse duration;

means for generating a reference rpm value;

transducer means for providing signals related to engine rpm and air flow rate;

circuit means, for receiving said signals related to engine rpm and air flow rate and for generating a pulse sequence whose pulse duration depends on engine rpm and air flow rate;

first comparator means for comparing the duration of said pulses with said reference pulse duration;

second comparator means for comparing the engine rpm with said reference rpm value; and control circuit means for interrupting the transmission of said pulse sequence to said injection valves when said pulse duration is less than said reference pulse duration and the engine rpm is greater than said reference rpm value.

4. An apparatus as defined by claim 3, wherein said timing means includes a monostable multivibrator whose time constant is equal to said reference pulse duration and wherein said first comparator means is a discriminator circuit with two output contacts whose potential is different and indicates if the duration of said pulses in said pulse sequence is greater or less than said reference pulse duration.

5. An apparatus as defined by claim 4, further comprising flip-flop means controlled by said first comparator means and connected at the output with one input of said control circuit means, the second input of said control circuit means being connected to the output of said second comparator means.

6. An apparatus as defined by claim 5, further comprising a pulse former circuit for receiving pulses from the ignition system of the engine and further comprising frequency divider means connected behind said pulse forming circuit; the output from said frequency divider means being connected to said circuit means for generating a pulse sequence whose duration depends on engine rpm and air flow rate, and further comprising a digital-to-analog converter for receiving said signals related to engine rpm and air flow rate and for providing an analog voltage fed to said second comparator means.

7. An apparatus as defined by claim 6, wherein said first comparator circuit includes two parallel branches respectively including two sequential transistors, the base electrodes of the transistors in one branch being controlled by said pulse sequence generated by said circuit means and the transistors in the other branch being controlled by a pulse train the width of which is said reference pulse duration.

8. An apparatus as defined by claim 7, wherein said digital-to-analog converter includes an integrating RC member whose analog output voltage is fed to the base of a transistor in said second comparator circuit whereby the emitter of said transistor in said second comparator circuit is provided with an adjustable threshold potential by adjustable resistors.

9. An apparatus as defined by claim 8, wherein said control circuit means includes an AND gate for controlling a switching transistor whose collector is connected to the transmission line leading to said fuel injection valves; whereby when said switching transistor conducts, said fuel injection control pulses are suppressed by conduction through said switching transistor.

* * * * *